US005679049A

United States Patent [19]

Arad et al.

[11] Patent Number: 5,679,049

[45] Date of Patent: Oct. 21, 1997

[54] TOY TELEPHONE RECORDING AND PLAYBACK

[75] Inventors: Avi Arad, Westport, Conn.; Robert W. Jeffway, Jr., 37 Front St., Leeds, Mass. 01053

[73] Assignee: Robert W. Jeffway, Jr., Leeds, Mass.

[21] Appl. No.: 675,805

[22] Filed: Jul. 5, 1996

Related U.S. Application Data

[63] Continuation of Ser. No. 382,998, Feb. 2, 1995, abandoned.

[51] Int. Cl.[6] ..... G10L 3/02; A63H 33/30; A63H 3/52

[52] U.S. Cl. ..... 446/142; 395/2.1; 395/2.81; 446/408; 446/484

[58] Field of Search ..... 446/141, 142, 446/143, 147, 397, 404, 408, 484; 369/31; 395/2.1, 2.81, 2.79

[56] References Cited

U.S. PATENT DOCUMENTS

| | | | |
|---|---|---|---|
| 4,318,188 | 3/1982 | Hoffmann | 365/45 |
| 4,568,912 | 2/1986 | Kitamura et al. | 395/2.1 X |
| 4,668,985 | 5/1987 | Kurashige et al. | 395/2.1 X |
| 4,772,873 | 9/1988 | Duncan | 395/2.1 X |
| 4,791,741 | 12/1988 | Kondo | 395/2.1 X |
| 4,890,259 | 12/1989 | Simko | 365/45 |
| 4,908,845 | 3/1990 | Little | 379/51 |
| 5,045,327 | 9/1991 | Tarlow et al. | 395/2.79 |
| 5,074,820 | 12/1991 | Nakayama | 446/297 X |
| 5,145,447 | 9/1992 | Goldfarb | 446/484 X |
| 5,184,971 | 2/1993 | Williams | 446/142 |
| 5,382,188 | 1/1995 | Tomellini | 446/397 |
| 5,433,610 | 7/1995 | Godfrey et al. | 446/397 X |
| 5,474,484 | 12/1995 | Lemelle | 446/142 |

FOREIGN PATENT DOCUMENTS

| | | | |
|---|---|---|---|
| 2225665 | 6/1990 | United Kingdom | 446/142 |

OTHER PUBLICATIONS

Single Chip Voice Record/Playback Devices, Feb. 1992, ISD, Inc., Inc.

*Primary Examiner*—Robert A. Hafer
*Assistant Examiner*—D. Neal Muir
*Attorney, Agent, or Firm*—Fish & Richardson P.C.

[57] ABSTRACT

A toy telephone includes a telephone base enclosure a microphone, a speaker, a memory chip for recording sounds for later retrieval, a microprocessor electrically connected to the memory chip, and at least one button electrically connected to the microprocessor for selecting one of a plurality of segments of the memory chip for recording. The memory chip is configured to produce an output signal the duration of which has a known mathematical relationship to the recording capacity of each of the plurality of segments of the memory chip. The microprocessor is programmed to receive an electrical signal from a button upon depression of the button, to select one of the segments of the memory chip in response to the depression of the button, to measure the duration of the output signal of the memory chip, to determine the recording capacity of the segment of the memory chip based on the duration of the output signal, to initiate recording of sounds received by the microphone into the segment of the memory chip, to terminate recording of the sounds when the recording capacity of the segment of the memory chip as determined by the microprocessor has been fully utilized, and to cause the sounds to be played at a later point in time.

24 Claims, 2 Drawing Sheets

TOY TELEPHONE RECORDING AND PLAYBACK

This is a continuation of application Ser. No. 08/382,998, filed Feb. 2, 1995, now abandoned.

An appendix is being submitted with the present application and is hereby incorporated herein by reference in its entirety.

BACKGROUND OF THE INVENTION

The present invention relates in general to recording and playback of sounds and more particularly concerns storing a plurality of recordings, e.g., spoken messages, on a single memory chip in a toy telephone while making efficient use of memory space.

It is known to construct a toy telephone using a number of memory chips for recording spoken messages and playing the messages back, each memory chip being associated with a respective push-button on the telephone. By pressing one of the push-buttons on the telephone, it is possible to cause the respective memory chip either to record a message spoken into a microphone or to play a message back over a speaker, depending on whether a "record" button on the telephone has been depressed. Such a toy telephone is described in Williams, U.S. Pat. No. 5,184,971.

SUMMARY OF THE INVENTION

It is an important Object of the present invention to provide an improved toy telephone capable of storing a plurality of recordings on a single memory chip in a toy telephone while making efficient use of memory space, and also to provide realistic telephone sounds generated by a sound effects chip.

According to the invention, there is a recording and playback device, e.g., a toy telephone, that includes a microphone, a speaker, a memory chip for recording sounds for later retrieval, a microprocessor electrically connected to the memory chip, and at least one control device, e.g., a button, electrically connected to the microprocessor for selecting one of a plurality of segments of the memory chip for recording. The memory chip is configured to produce an output signal the duration of which has a known mathematical relationship to the recording capacity of each of the plurality of segments of the memory chip. The microprocessor is programmed to receive an electrical signal from the control device upon activation of the control device, to select one of the segments of the memory chip in response to the activation of the control device, to measure the duration of the output signal of the memory chip, to determine the recording capacity of the segment of the memory chip based on the duration of the output signal, to initiate recording of sounds received by the microphone into the segment of the memory chip, to terminate recording of the sounds when the recording capacity of the segment of the memory chip as determined by the microprocessor has been fully utilized, and to cause the sounds to be played at a later point in time.

Because the microprocessor measures the duration of an output signal of the memory chip that has a known mathematical relationship to the recording capacity of a segment of the memory chip selected for recording, the microprocessor can terminate recording of sounds when the recording capacity of the segment of the memory chip has been fully utilized, with very little timing error and hence little risk that a portion of the recorded sounds will spill over into another, non-selected segment of the memory chip. This is because the timing of the recording is independent of the oscillator frequency tolerances of the memory chip and the microprocessor. The space-efficient storing of several recordings onto a single memory chip in accordance with the invention is cost effective.

According to another aspect of the invention, there is a toy telephone that includes a telephone base enclosure, a microphone, a speaker, a memory chip located within the telephone base enclosure and configured to record sounds for later retrieval, a microprocessor located within the telephone base enclosure and electrically connected to the memory chip, and at least one control device electrically connected to the microprocessor for initiating playback of a recording. The microprocessor is programmed to initiate recording of sounds received by the microphone into the memory chip, and, in response to activation of the control device, to cause electrical signals to be sent to the speaker to cause the speaker to emit realistic telephone sound effects such as touch tone dialing, a busy signal, and an automatic ring back, and to cause the sounds recorded into the memory chip to be played through the speaker.

Numerous other features, objects, and advantages of the invention will become apparent from the following detailed description when read in connection with the accompanying drawings.

DETAILED DESCRIPTION

Figure 1:
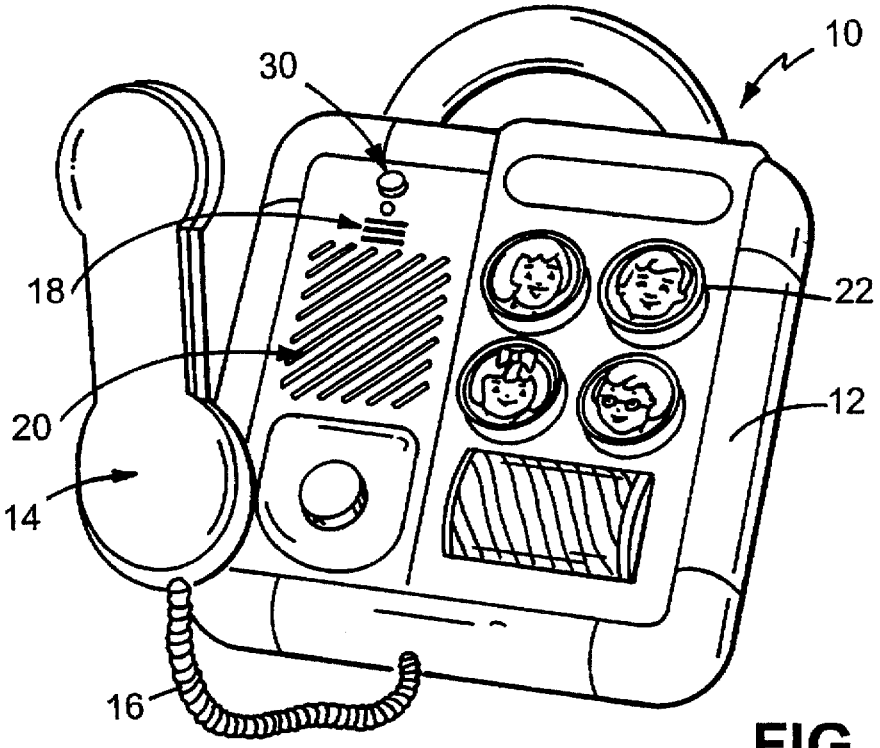
FIG. 1 is perspective drawing of a toy telephone in accordance with the invention.

With reference now to the drawings and more particularly FIG. 1 thereof, toy telephone 10 includes a base enclosure 12 and a handset 14 connected to base enclosure 12 by non-electric cord 16. Handset 14 fits within a cradle on the top of base enclosure 12. Microphone 18 and speaker 20 are provided in the cradle area of base enclosure 12 for recording and playback of messages respectively. Base enclosure 12 includes a set of large round message buttons 22 for initiating recording or playback of respective messages upon depression of respective message buttons. Message buttons 22 include labels having pictorial representations of different people. It is contemplated that when a person leaves a message for the child the person will depress a message button having a pictorial representation similar to that person's actual appearance. The message buttons are also sufficiently large to permit an adult to paste 1-inch circular cut-outs of photographs or drawings of actual people onto the message buttons. A play/record button (not visible in FIG. 1) is provided on the base enclosure for selecting a "play" mode of operation or a "record" mode of operation. When the "record" mode of operation is selected, a record LED 30 on base enclosure 12 lights up.

Figure 2:
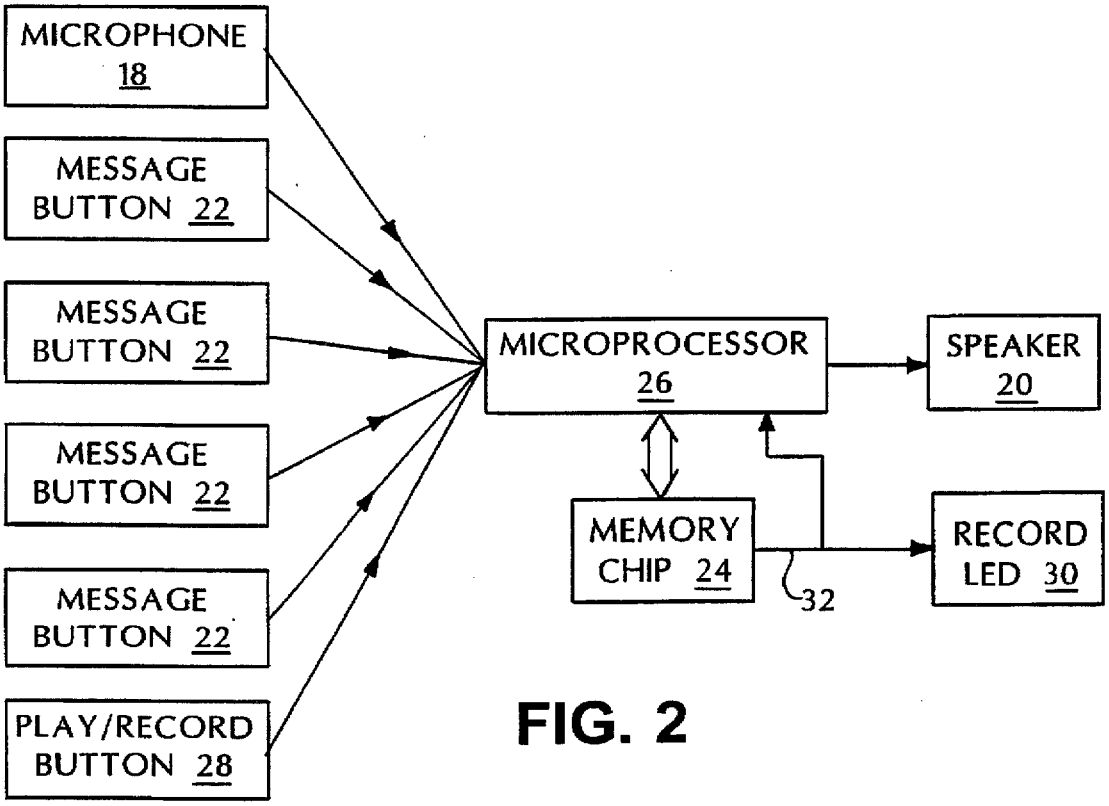
FIG. 2 is a block diagram of the electrical components of the toy telephone of FIG. 1.

With reference now to FIG. 2, the electrical components of the toy telephone include a microprocessor 26 electrically interfacing with memory chip 24, microphone 18, speaker 20, message buttons 22, and play/record button 28. A record LED 30 is electrically connected to memory chip 24.

Memory chip 24 is an ISD 1110 chip that has 80 cells for storing a total of about 10 seconds of spoken messages. Thus, when memory chip 24 is divided into four equal segments corresponding to the four message buttons 22, each segment of memory chip 24 has 20 cells for storing about 2.5 seconds of a spoken message.

Signal output 32 of memory chip 24 causes record LED 30 to light up while memory chip 24 is in the "record" mode of operation. Signal output 32 also pulses once whenever memory chip 24 finishes playing a recorded message. The width of this pulse is equal to one-eighth the time period of a single recording cell. Thus, each of the four segments of memory chip 24 has a recording capacity equal to 160 (20 times 8) times the width of the pulse on signal output 32. Signal output 32 is connected to microprocessor 26, which is programmed to measure the duration of the pulse on signal output 32 to determine the recording capacities of the four segments of the memory chip based on the duration of the output signal.

Microprocessor 26 is a TSP 50C04 chip programmed to respond to depression of any one of message buttons 22 while play/record button 28 is set to a "record" mode of operation by instructing memory chip 24 to record a spoken message in the segment of the memory that corresponds with the respective message button 22. Microprocessor chip 26 is programmed to respond to depression of any one of message buttons 22 while play/record button 28 is set to a "play" mode of operation by instructing memory chip 24 to play a spoken message stored in that segment of the memory chip. Microprocessor 26 is programmed to instruct memory chip 24 to terminate recording of each spoken message when the recording capacity of the corresponding segment of the memory chip has been fully utilized, based on the duration of the pulse on signal output 32 as measured by microprocessor 26.

Memory chip 24 has a clock with an oscillator frequency tolerance of plus or minus 6 percent, and the clock on microprocessor 26 has an oscillator frequency tolerance of plus or minus 10 percent.

Having described the structure, the mode of operation will be described.

If a child wishes to listen to recorded messages, play/record button 28 must first be set to the "play" mode of operation. The child can then press any one of the four message buttons 22, corresponding to the person whose message the child wishes to hear. Microprocessor 26 receives an electrical signal from the message button 22 that has been pressed, and causes the sounds of touch tone dialing to be played over speaker 20. Microprocessor 26 is programmed to occasionally cause, at random intervals, a busy signal to be played over speaker 20 instead, followed by an automatic ring back. Following the sounds of touch tone dialing or automatic ring back, microprocessor 26 instructs memory chip 24 to play a message stored in the segment of the memory corresponding to the message button 22 that has been pressed. The stored message is originally preset as "Your personal message 1" (or "2," "3," or "4," as appropriate for each message button 22), but the stored message is replaced with a new personal message every time someone records a spoken message in the appropriate segment of the memory chip. If the child presses another message button 22 during playback of a message, microprocessor interrupts the first message and causes the message stored in the segment of memory corresponding to the other message button to be played instead.

If someone wishes to record a message for the child, play/record button 28 must first be set to the "record" mode of operation. The person can then press the message button 22 that corresponds with that person's identity.

Figure 3:
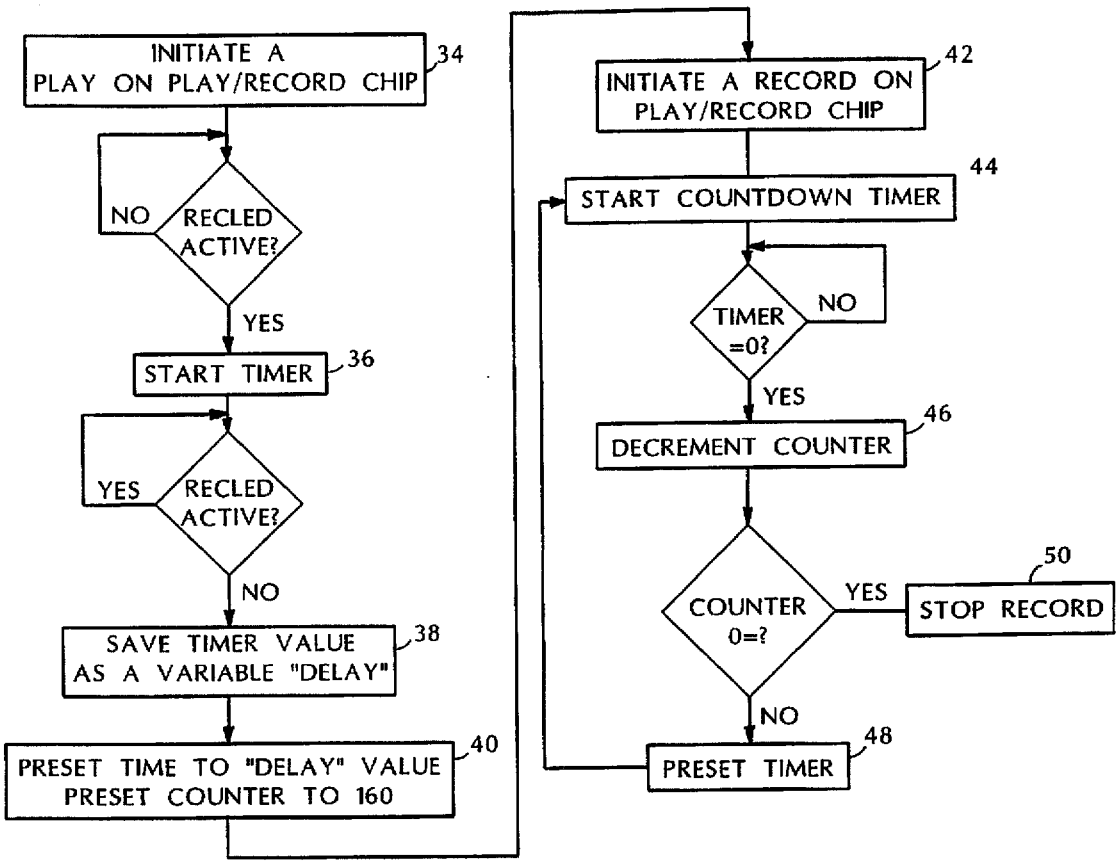
FIG. 3 is a flow-chart diagram illustrating the operation of the microprocessor shown in FIG. 2.

With reference now to FIG. 3, when the microprocessor receives an electrical signal from the message button that has been pressed during the "record" mode of operation, the microprocessor instructs the memory chip first to play the message previously stored in the segment of the memory corresponding to the message button that has been pressed (step 34). After the memory chip has finished playing the message previously stored in the appropriate segment of the memory, the signal output of the memory chip pulses for a time duration equal to one-eighth the time period of a single recording cell, thereby activating the record LED. As soon as the record LED is activated, the microprocessor starts a timer (step 36), and when the record LED is de-activated at the end of the pulse on the signal output of the memory chip, the microprocessor saves the current timer value as the variable "delay" (step 38).

The microprocessor then presets a timer to the "delay" value and presets a counter to 160 (step 40), causes a single short tone to be played over the speaker to alert the user that recording is about to begin, and instructs the memory chip to initiate recording at the beginning of the appropriate segment of memory (step 42). The signal output of the memory chip activates the record LED and the user speaks into the microphone to record the message. Upon instructing the memory chip to initiate a recording, microprocessor starts the countdown timer (step 44). When the timer reaches zero, the microprocessor decrements the counter (step 46), presets the timer again to the "delay" value (step 48), and returns to step 44. When the counter reaches zero, the microprocessor instructs the memory chip to stop recording (step 50) and causes another single short tone to be played over the speaker to alert the user that recording has been terminated.

The microprocessor terminates recording of a spoken message when the recording capacity of the segment of the memory chip has been fully utilized, without timing errors due to the oscillator frequency tolerances of the memory chip (plus or minus 6 percent) and the microprocessor (plus or minus 10 percent), which equal a total tolerance of 32 percent. It can be seen that timing errors due to oscillator frequency tolerances would otherwise make it necessary to throw away approximately one-third of the 2.5 second recording time of each segment of memory to avoid spill-over of the recording into a non-selected segment of memory.

The memory chip can be thought of as a recording tape divided into four equal-length segments. If the total length of the tape in inches is known, and if the time it takes for one inch of tape to pass the tape head is measured during a playback, then it is possible to set the record time in inches of tape rather than seconds, in which case it is possible to accurately record on one-quarter of the total tape length regardless of the speed of the tape and regardless of whether the timer is fast or slow.

The program of instructions for the microprocessor is listed in the above-mentioned appendix.

There has been described novel and improved apparatus and techniques for recording. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

We claim:

1. A recording and playback device, comprising:

a microphone;

a speaker;

a memory chip having a first clock with a first oscillator frequency tolerance, said memory chip being configured to record sounds for later retrieval;

a microprocessor having a second clock with a second oscillator frequency tolerance and being electrically connected to said memory chip; and at least one control device electrically connected to said microprocessor for selecting one of a plurality of segments of said memory chip for recording;

said memory chip having an output circuit that produces an output signal the duration of which has a known mathematical relationship to the recording capacity of each of said plurality of segments of said memory chip;

said microprocessor receiving an electrical signal from said control device upon activation of said control device and receiving said output signal said memory chip; and said microprocessor being programmed to;

select one of said plurality of segments of said memory chip in response to the electrical signal from said control device, measure the duration of said output signal of said memory chip, determine said recording capacity of said one of said plurality of segments of said memory chip based on said duration of said output signal, initiate recording of sounds received by said microphone into said one of said plurality of segments of said memory chip, terminate recording of said sounds when said recording capacity of said one of said plurality of segments of said memory chip as determined by said microprocessor has been fully utilized to thereby prevent recording of said sounds beyond said one of said plurality of segments of said memory chip due to the oscillator frequency tolerances of said memory chip and said microprocessor, and cause said sounds to be reproduced through said speaker at a later point in time.

2. A recording and playback device in accordance with claim 1, wherein there are a plurality of control devices electrically connected to said microprocessor.

3. A recording and playback device in accordance with claim 2, wherein each of said plurality of control devices corresponds to a respective one of said plurality of segments of said memory chip.

4. A recording and playback device in accordance with claim 1, wherein said duration of said output signal of said memory chip is directly proportional to said recording capacity of said one of said plurality of segments of said memory chip.

5. A recording and playback device accordance with claim 4, wherein said microprocessor is programmed to set a counter value proportional to said recording capacity of said one of said plurality of segments of said memory chip divided by said duration of said output signal of said memory chip, and, upon initiating recording of said sounds in said one of said plurality of segments of said memory chip, to repeatedly decrement said counter value at timer intervals proportional to said duration of said output signal of said memory chip until said counter value reaches a value representing full utilization of said recording capacity, at which point said microprocessor terminates recording of said sounds.

6. A recording and playback device in accordance with claim 5, wherein said counter value is equal to said recording capacity of said one of said plurality of segments of said memory chip divided by said duration of said output signal of said memory chip, and said timer intervals are equal to said duration of said output signal of said memory chip.

7. A toy telephone, comprising:

a telephone base enclosure;

a microphone;

a speaker;

a memory chip having a first clock with a first oscillator frequency tolerance, located within said telephone base enclosure, said memory chip being configured to record sounds for later retrieval;

a microprocessor paving a second clock with a second oscillator frequency tolerance and being located within said telephone base enclosure and electrically connected to said memory chip; and at least one button electrically connected to said microprocessor for selecting one of a plurality of segments of said memory chip for recording;

said memory chip having an output circuit that produces an output signal the duration of which has a known mathematical relationship to the recording capacity of each of said plurality of segments of said memory chip;

said microprocessor receiving an electrical signal from said button upon depression of said button and receiving said output signal said memory chip; and said microprocessor being programmed to:

select one of said plurality of segments of said memory chip in response to the electrical signal from said button, measure the duration of said output signal of said memory chip, determine said recording capacity of said one of said plurality of segments of said memory chip based on said duration of said output signal, initiate recording of sounds received by said microphone into said one of said plurality of segments of said memory chip, terminate recording of said sounds when said recording capacity of said one of said plurality of segments of said memory chip as determined by said microprocessor has been fully utilized to thereby prevent recording of said sounds beyond said one of said plurality of segments of said memory chip due to the oscillator frequency tolerances of said memory chip and said microprocessor, and cause said sounds to be played through said speaker at a later point in time.

8. A toy telephone in accordance with claim 7, further comprising a telephone handset and a cord connecting said telephone handset with said telephone base enclosure.

9. A toy telephone in accordance with claim 8, wherein said microphone and said speaker are incorporated into said telephone base enclosure.

10. A toy telephone in accordance with claim 7, wherein said toy telephone comprises only one memory chip.

11. A toy telephone in accordance with claim 7, further comprising a play/record button for selecting between a record mode of operation in which said at least one button selects one of a plurality of segments of said memory chip for recording, and a play mode of operation in which said at least one button selects one of a plurality of segments of said memory chip for playback.

12. A toy telephone in accordance with claim 7, wherein there are a plurality of buttons electrically connected to said microprocessor.

13. A toy telephone in accordance with claim 12, wherein each of said plurality of buttons corresponds to a respective one of said plurality of segments of said memory chip.

14. A toy telephone in accordance with claim 12, wherein each one of said plurality of buttons comprises a representation of a person associated with said one of said plurality of buttons.

15. A toy telephone in accordance with claim 14, wherein said representation comprises a picture.

16. A toy telephone in accordance with claim 12, wherein each of said buttons is sufficiently large to permit cut-outs of photographs or drawings of actual people to be pasted onto said buttons.

17. A toy telephone in accordance with claim 7, wherein said duration of said output signal of said memory chip is directly proportional to said recording capacity of said one of said plurality of segments of said memory chip.

18. A toy telephone in accordance with claim 17, wherein said microprocessor is programmed to set a counter value proportional to said recording capacity of said one of said plurality of segments of said memory chip divided by said duration of said output signal of said memory chip, and, upon initiating recording of said sounds in said one of said plurality of segments of said memory chip, to repeatedly decrement said counter value at timer intervals proportional to said duration of said output signal of said memory chip until said counter value reaches a value representing full utilization of said recording capacity, at which point said microprocessor terminates recording of said sounds.

19. A toy telephone in accordance with claim 18, wherein said counter value is equal to said recording capacity of said one of said plurality of segments of said memory chip divided by said duration of said output signal of said memory chip, and said timer intervals are equal to said duration of said output signal of said memory chip.

20. A toy telephone in accordance with claim 7, wherein said output signal comprises an output for a record indicator.

21. A toy telephone in accordance with claim 7, wherein said memory chip is configured to produce said output signal upon completing playback.

22. A toy telephone in accordance with claim 21, wherein said microprocessor is further programmed to initiate playback of sounds stored in said one of said plurality of segments of said memory chip upon receipt of said electrical signal from said button.

23. A toy telephone in accordance with claim 7, wherein said microprocessor is further programmed to cause electrical signals to be sent to said speaker to cause said speaker to emit realistic telephone sound effects immediately before causing said sounds recorded by said memory chip to be played through said speaker at said later point in time.

24. A toy telephone, comprising:

a telephone base enclosure;

a telephone handset;

a cord connecting said telephone handset with said telephone base enclosure;

a microphone;

a speaker;

a memory chip having a first clock with a first oscillator frequency tolerance, located within said telephone base enclosure, said memory chip being configured to record sounds for later retrieval;

a microprocessor having a second clock with a second oscillator frequency tolerance and being located within said telephone base enclosure and electrically connected to said memory chip; and a plurality of buttons electrically connected to said microprocessor, each of said buttons corresponding to a respective one of a plurality of segments of said memory chip, for selecting one of a plurality of segments of said memory chip for recording and playback;

said memory chip having an output circuit that produces an output signal the duration of which is directly proportional to the recording capacity of each of said plurality of segments of said memory chip;

said microprocessor receiving an electrical signal from one of said plurality of buttons upon depression of said one of said plurality of buttons and receiving said output signal said memory chip; and said microprocessor being programmed to:

select one of said plurality of segments of said memory chip in response to the electrical signal from said button, measure the duration of said output signal of said memory chip, set a counter value equal to said recording capacity of said one of said plurality of segments of said memory chip divided by said duration of said output signal of said memory chip, initiate recording of sounds received by said microphone into said one of said plurality of segments of said memory chip, and, upon initiating recording of said sounds, repeatedly decrement said counter value at timer intervals equal to said duration of said output signal of said memory chip until said counter value reaches a value representing full utilization of said recording capacity, terminate recording of said sounds when said counter value reaches said value representing full utilization of said recording capacity to thereby prevent recording of said sounds beyond said one of said plurality of segments of said memory chip due to the oscillator frequency tolerances of said memory chip and said microprocessor, and cause said sounds to be played through said speaker at a later point in time.

* * * * *